US006454592B2

(12) United States Patent
Takagi

(10) Patent No.: US 6,454,592 B2
(45) Date of Patent: Sep. 24, 2002

(54) CONNECTOR WITH AN IMPROVED GUIDE PORTION FOR GUIDING CONNECTION THE CONNECTOR AND AN OBJECT TO BE CONNECTED THERETO

(75) Inventor: Osamu Takagi, Oume (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/738,442

(22) Filed: Dec. 15, 2000

(30) Foreign Application Priority Data

Dec. 21, 1999 (JP) ..... 11-362816

(51) Int. Cl.[7] ..... H01R 13/627
(52) U.S. Cl. ..... 439/378; 439/353
(58) Field of Search ..... 439/378, 353, 439/358, 357, 188, 953

(56) References Cited

U.S. PATENT DOCUMENTS 3,394,337 A * 7/1968 Miller
5,316,493 A * 5/1994 Sowers ..... 439/346
5,487,678 A * 1/1996 Tsuji et al. ..... 439/352
5,611,707 A * 3/1997 Meynier ..... 439/353
6,113,415 A * 9/2000 Bertch et al. ..... 439/353

OTHER PUBLICATIONS

Unexamined Japanese Patent Publication H07–335296 (cited on p. 1 of specification).
Unexamined Japanese Patent Publication H09–320684 (cited on p. 1 of specification).

* cited by examiner

*Primary Examiner*—Brian Sircus
*Assistant Examiner*—J. F. Duverne
(74) *Attorney, Agent, or Firm*—Michael Best & Friedrich LLC; J. Warren Whitsel

(57) ABSTRACT

In a connector having a principal surface (44*a*) to be faced to an object in a first direction (A1) and a guide portion (45) protruding from the principal surface in the first direction for guiding connection of the connector and the object, the guide portion has elasticity so as to be elastically bent in a second direction (A2) transverse to the first direction. It is preferable that the guide portion has a slit (51) to provide the elasticity.

9 Claims, 9 Drawing Sheets

RELATED TECHNIQUE

RELATED TECHNIQUE

RELATED TECHNIQUE

RELATED TECHNIQUE

RELATED TECHNIQUE

RELATED TECHNIQUE

RELATED TECHNIQUE

CONNECTOR WITH AN IMPROVED GUIDE PORTION FOR GUIDING CONNECTION THE CONNECTOR AND AN OBJECT TO BE CONNECTED THERETO

BACKGROUND OF THE INVENTION

This invention relates to a connector having a guide portion for guiding connection of the connector and an object to be connected thereto.

A connector of the type having a guide portion is disclosed, for example, in Japanese Unexamined Patent Publications (JP-A) Nos. H07-335296 and H09-320684. In the connector, the guide portion is formed as a part integral with an insulator made of a hard material and holding a contact.

For example, a mobile telephone is provided with a connector to be used when a battery is charged. Typically, the contact used in the connector is of a butt-contact type in which the contact and a mating contact of a mating connector as an object are pressed against each other in a predetermined direction. The insulator is provided with a lock mechanism for stably holding the contact and the mating contact in a contacting state.

It is assumed as a particular case that the connector of the above-mentioned structure is connected to the mating connector and thereafter disconnected therefrom without releasing the lock mechanism. In the particular case, an excessive force may be applied in a direction perpendicular to the predetermined direction, so that the insulator is damaged, for example, cracked. This is because the insulator is poor in flexibility.

SUMMARY OF THE INVENTION

It is therefore an object of this invention to provide a connector having a structure which is not subject to damage.

According to this invention, there is provided a connector having a principal surface to be faced to an object in a first direction and a guide portion protruding from the principal surface in the first direction for guiding connection of the connector and the object, wherein the guide portion has elasticity so as to be elastically bent in a second direction transverse to the first direction.

DESCRIPTION OF THE PREFERRED EMBODIMENT

Referring to FIGS. 1 through 7, description will at first be made of a related technique in order to facilitate an understanding of this invention.

Figure 1:
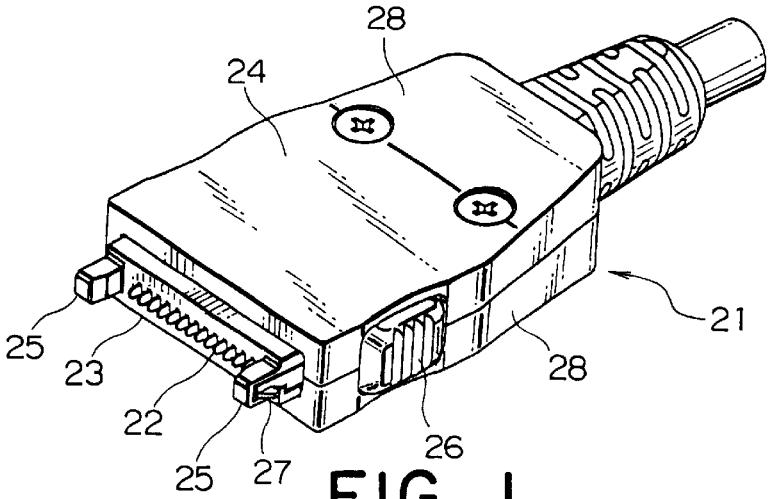
FIG. 1 is an external perspective view of a connector according to a related technique.
Figure 2:
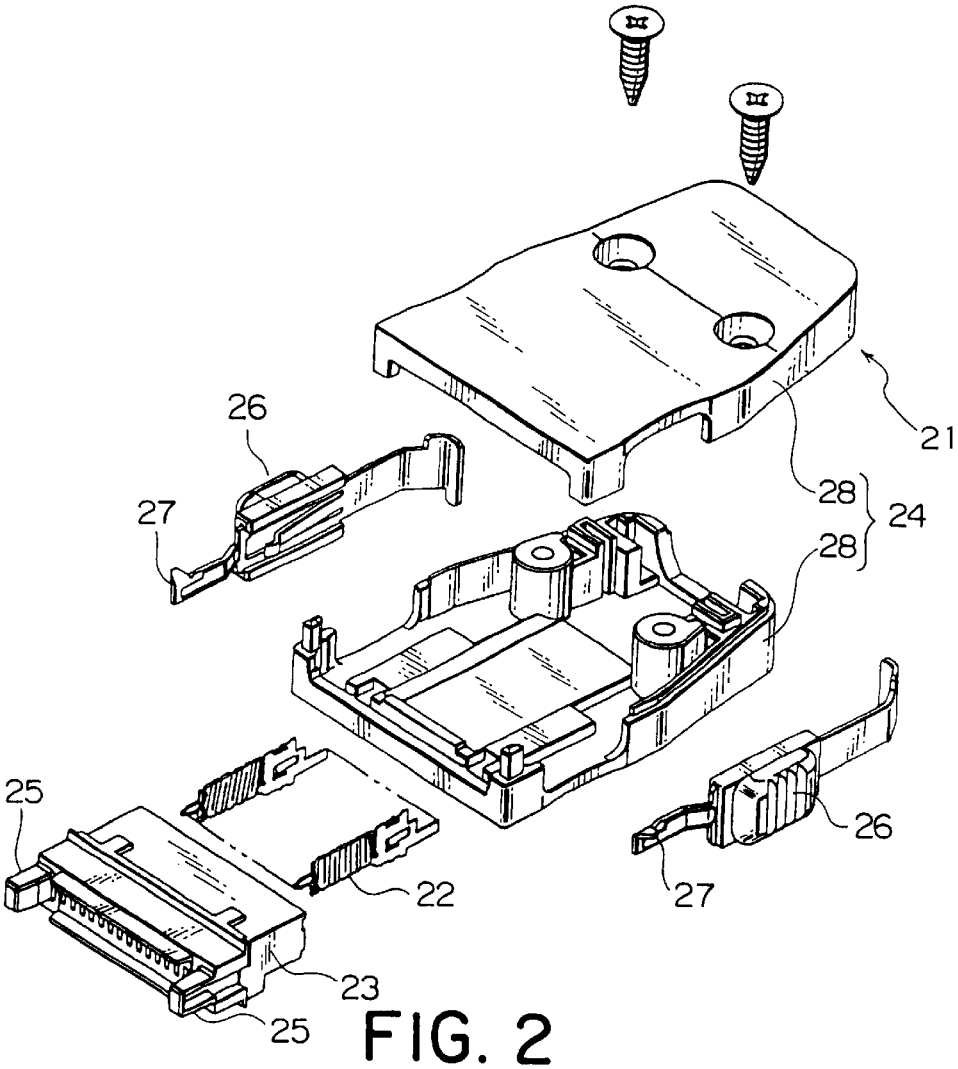
FIG. 2 is an exploded perspective view of the connector illustrated in FIG. 1.

A connector illustrated in FIGS. 1 and 2 is a plug connector 21 comprising a plurality of electroconductive contacts 22, an insulator 23 holding the contacts 22, and a hood 24 covering the insulator 23. The insulator 23 has a pair of guide portions 25 protruding from positions near to opposite ends thereof to be in parallel to each other. Each of the guide portions 25 is made of a heat-resistant hard material and formed as an integral part integral with the insulator 23. The guide portions 25 serve to guide coupling of the plug connector 21 and a mating connector which will later be described. Each of the guide portions 25 is provided with a slide groove for receiving a locking claw 27 connected to a lock mechanism operating portion 26.

The hood 24 comprises a pair of hood components 28 butted to each other and fixed by a fixture such as a screw. The lock mechanism operating portion 26 is movably held by the hood 24.

Figure 3:
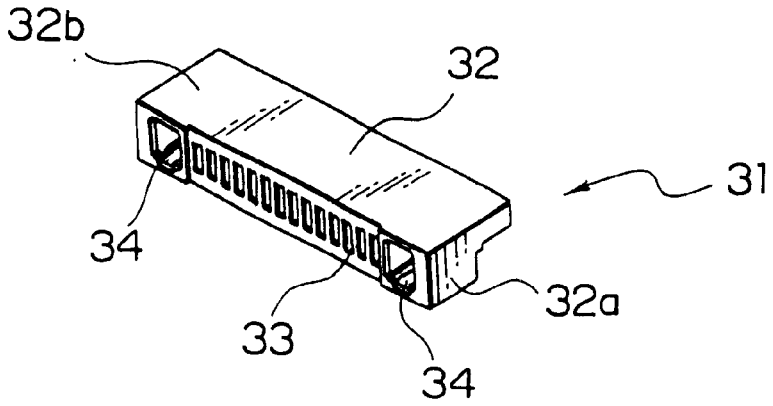
FIG. 3 is an external perspective view of a mating connector to be connected to the connector illustrated in FIG. 1.
Figure 4:
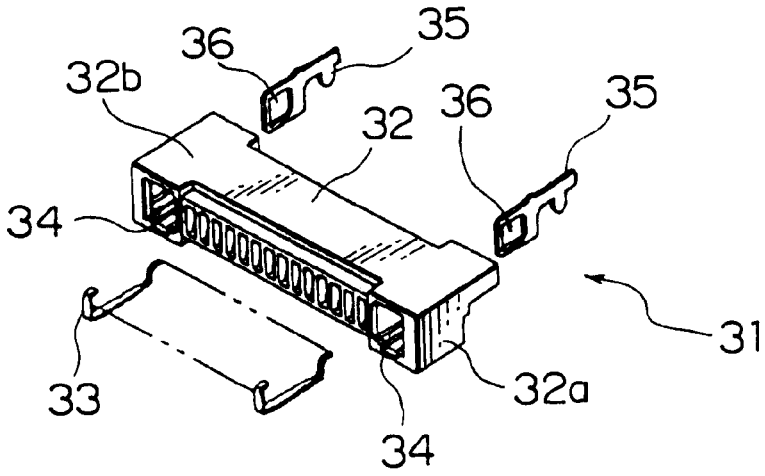
FIG. 4 is an exploded perspective view of the mating connector illustrated in FIG. 3.

Referring to FIGS. 3 and 4, the mating connector is a receptacle connector 31 to be coupled and connected to the plug connector 21 in FIGS. 1 and 2 in a first direction. The receptacle connector 31 comprises an insulator 32 and a plurality of electroconductive mating contacts 33 held between opposite ends 32*a* and 32*b* of the insulator 32.

The insulator 32 is provided with a pair of recessed portions 34 formed at the opposite ends 32*a* and 32*b* for receiving the guide portions 25, respectively. To each of the recessed portions 34, a lock plate 35 is fixed. The lock plate 35 has a locking hole 36 to be engaged with the locking claw 27 of the plug connector 21.

Figure 5:
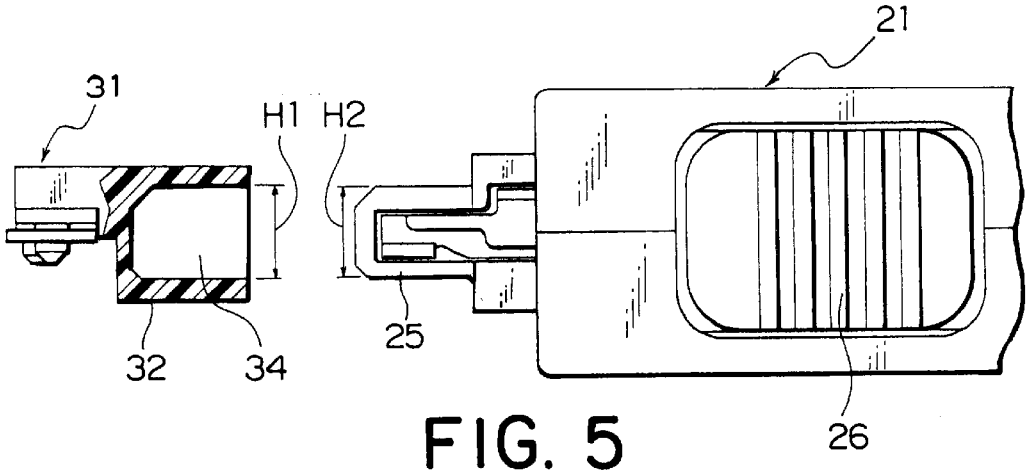
FIG. 5 is a partially-sectional side view showing the connector in FIG. 1 and the mating connector in FIG. 3 in a disconnected state.
Figure 6:
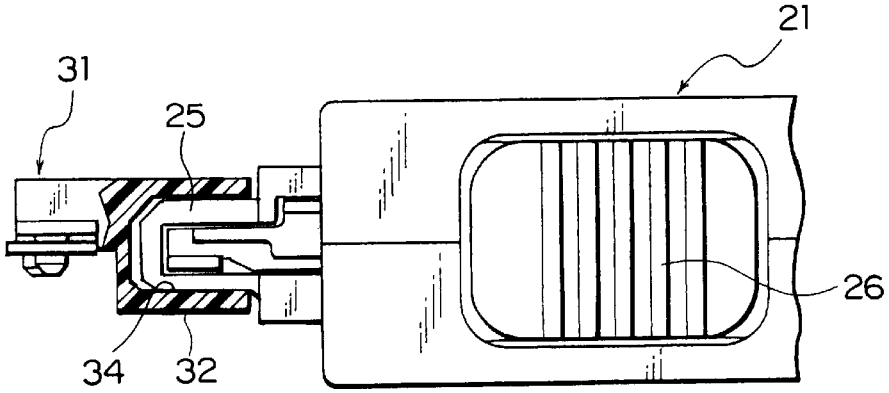
FIG. 6 is a view similar to FIG. 5 but in a connected state.
Figure 7:
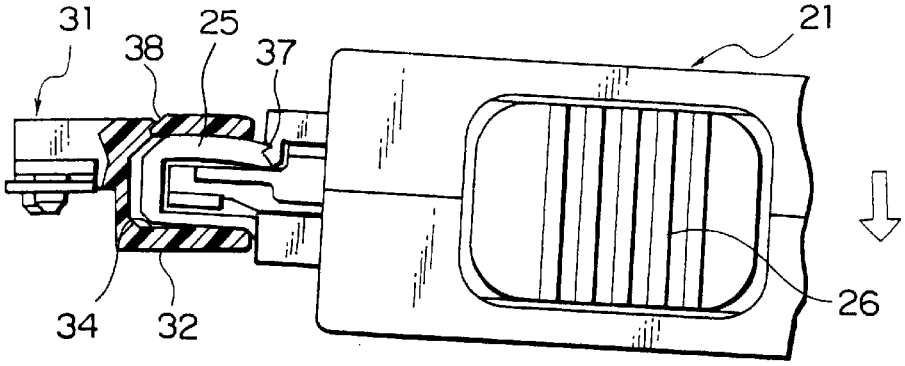
FIG. 7 is a view similar to FIG. 6 but when an external force is applied to one of the connectors connected to each other.

Referring to FIG. 5, the recessed portion 34 has an internal dimension H1 greater than an external dimension H2 of the guide portion 25. Therefore, as illustrated in FIG. 6, a gap is formed between the inner surface of the recessed portion 34 and the outer surface of the guide portion 25 when the plug connector 21 is coupled to the mating connector 31. Due to the presence of the gap, mutual contact between the contacts 22 and the mating contacts 33 is unstable.

Since the guide portion 25 is made of the heat-resistant hard material and formed as the integral part integral with the insulator 23, the guide portion 25 is poor in flexibility. Therefore, if the plug connector 21 is subjected to an external force as depicted by a thick white arrow in FIG. 7, cracks may often be produced as depicted by reference numerals 37 and 38 in the figure.

Referring to FIGS. 8 through 15, description will now be made of a connector according to one embodiment of this invention.

Figure 8:
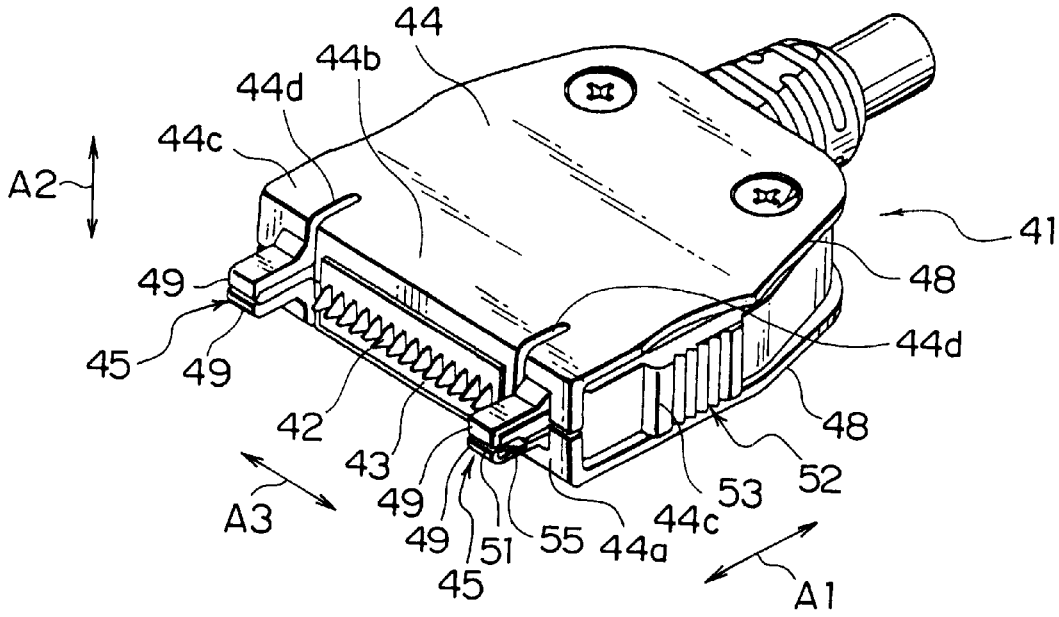
FIG. 8 is an external perspective view of a connector according to one embodiment of this invention.
Figure 9:
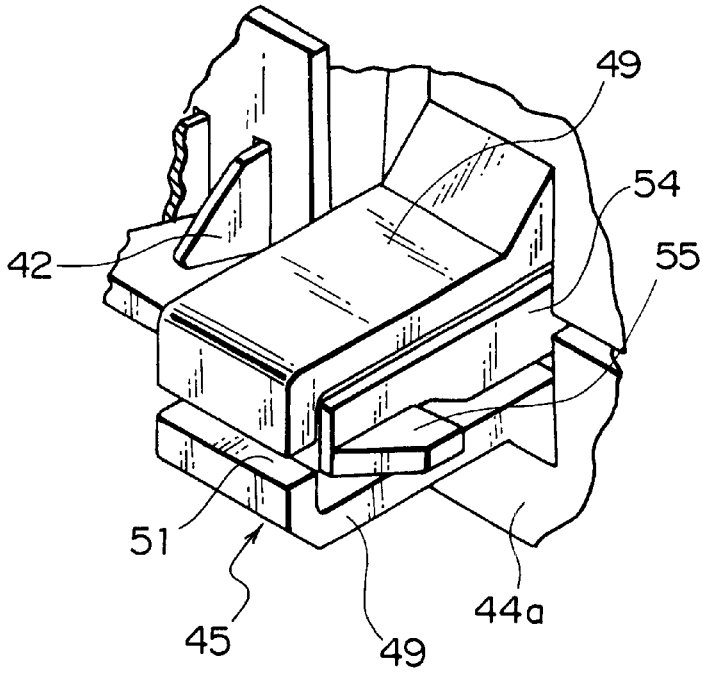
FIG. 9 is an enlarged perspective view of a characteristic part of the connector illustrated in FIG. 8.
Figure 10:
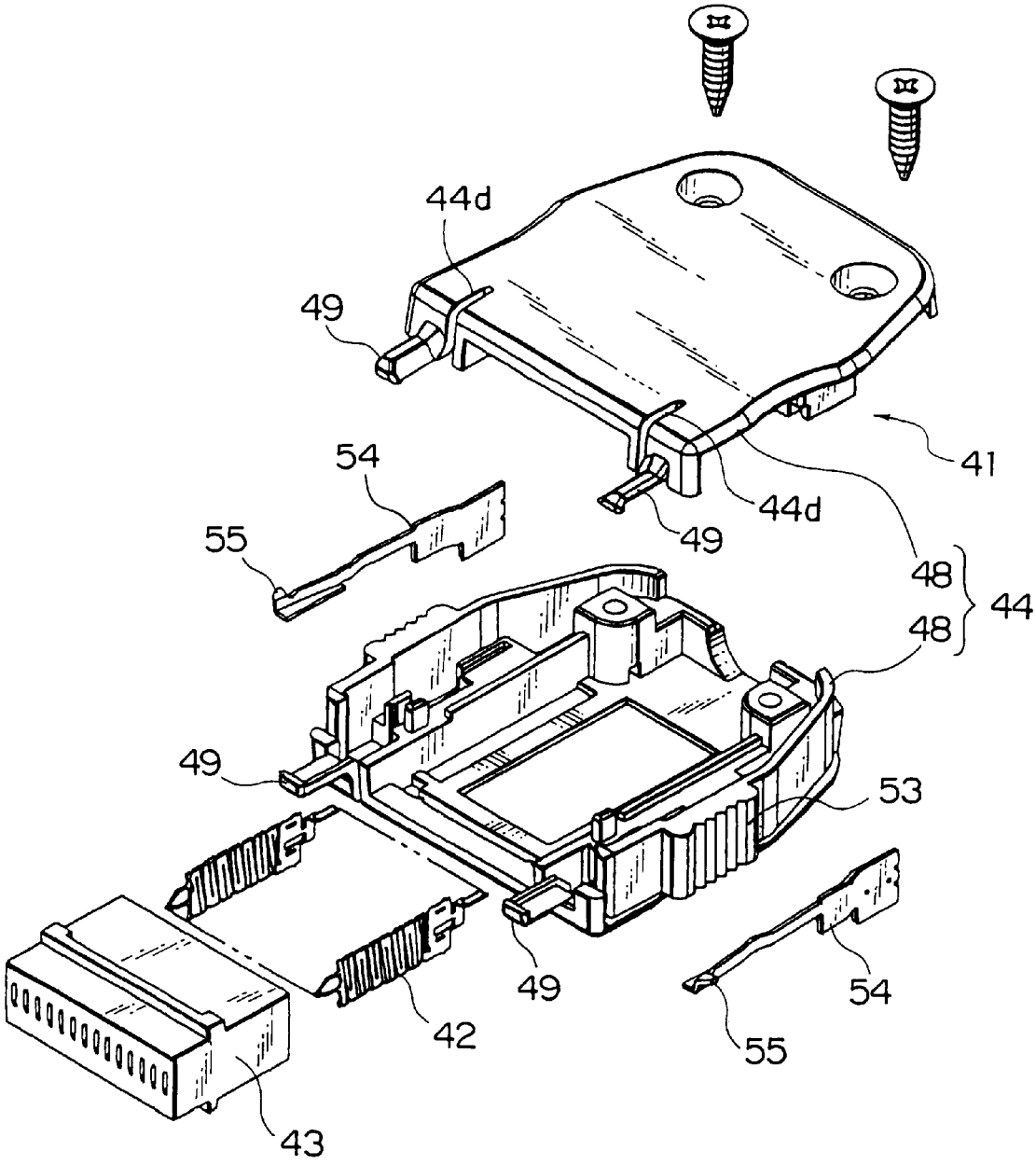
FIG. 10 is an exploded perspective view of the connector illustrated in FIG. 8.

The connector illustrated in FIGS. 8 through 10 is a plug connector 41 to be coupled and connected to a mating connector (which will later be described) in a first direction A1. The plug connector 41 comprises a plurality of electroconductive contacts 42, an insulator 43 holding the contacts 42, and a hood 44 covering the insulator 43. Each of the contacts 42 is of a butt-contact type and has a part protruding in the first direction A1 from the insulator 43 faced to the mating connector.

The hood 44 has a principal surface 44*a* to be faced to the mating connector in the first direction A1. The hood 44 is provided with a pair of guide portions 45 protruding from the principal surface 44*a* in the first direction A1 to guide connection of the plug connector 41 and the mating connector. As will hereinafter be described, the guide portion 45 has elasticity so as to be elastically bendable in a second direction A2 perpendicular to the first direction A1.

The hood 44 comprises a pair of hood components 48 butted to each other in the second direction A2 and fixed by a fixture such as a screw. Each of the guide portions 45 comprises a combination of a pair of protruding portions 49 integral with the hood components 48, respectively. The protruding portions 49 are faced to each other in the second direction A2. Each of the protruding portions 49 has elasticity to be elastically bendable in the second direction A2. Between the protruding portions 49, a gap or a slit 51 is left to provide the elasticity.

The hood 44 has a hood center portion 44*b* located at the center in a third direction A3 perpendicular to the first and the second directions A1 and A2, and a pair of hood end portions 44*c* located at opposite ends in the third direction A3. Between the hood center portion 44*b* and each of the hood end portions 44*c*, a slit 44*d* is formed. The guide portion 45 protrudes from each of the hood end portions 44*c* in the first direction A1.

The plug connector 41 further comprises a lock mechanism 52 for locking a connected state between the plug connector 41 and the mating connector. The lock mechanism 52 comprises an operating portion 53 formed on the hood 44 to be movable in the first direction A1, and a lock spring 54 located between the protruding portions 49 and cooperating with the operating portion 53. The lock spring 54 has a locking claw 55 to be engaged with the mating connector in the first direction A1.

Figure 11:
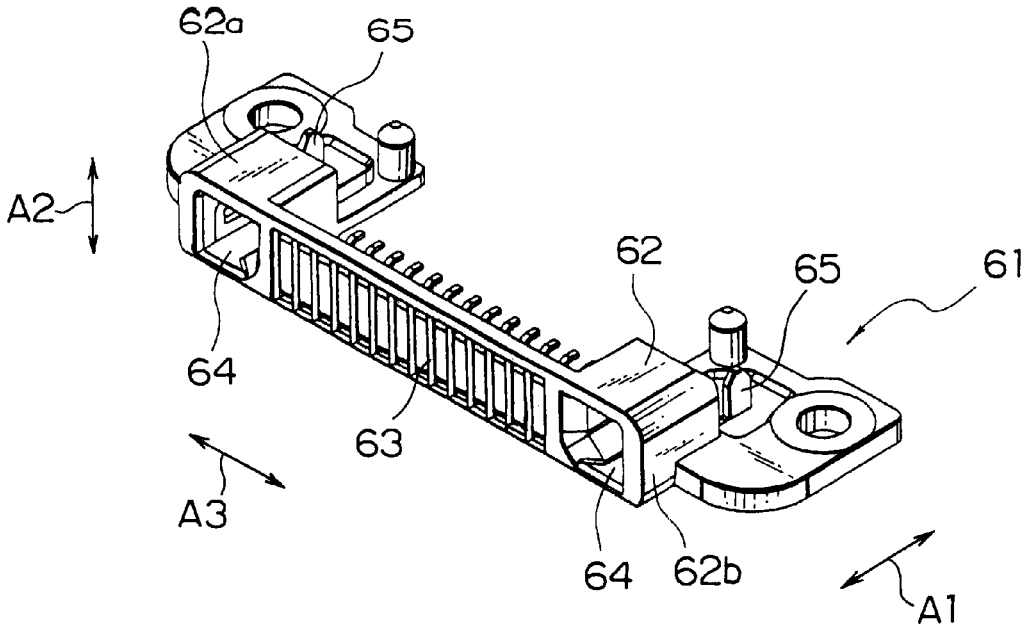
FIG. 11 is an external perspective view of a mating connector to be connected to the connector illustrated in FIG. 8.
Figure 12:
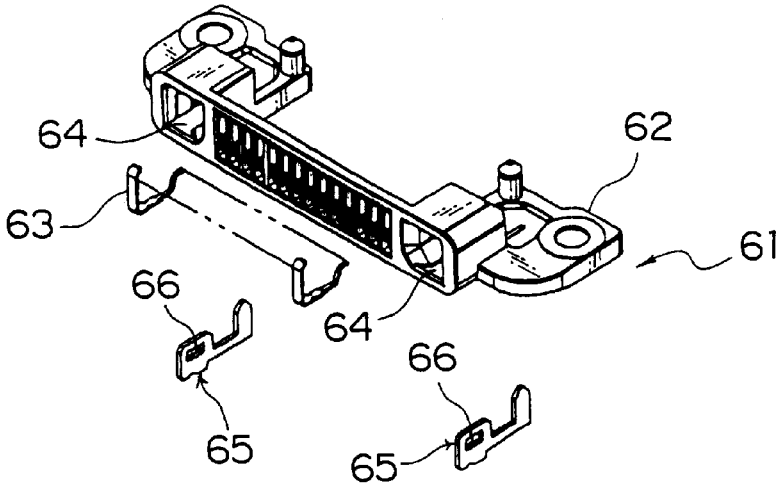
FIG. 12 is an exploded perspective view of the mating connector illustrated in FIG. 11.

Referring to FIGS. 11 and 12, the mating connector is a receptacle connector 61 to be coupled and connected to the plug connector 41 in FIGS. 8 through 10 in the first direction A1. The receptacle connector 61 comprises an insulator 62 and a plurality of electroconductive mating contacts 63 held between opposite ends 62*a* and 62*b* of the insulator 62.

The insulator 62 is provided with a pair of recessed portions 64 formed at opposite ends 62*a* and 62*b* to receive the guide portions 45, respectively. To each of the recessed portions 64, a lock plate 65 is fixed. Each of the lock plates 65 has a locking hole 66 to be engaged with the locking claw 54 of the plug connector 41.

Figure 13:
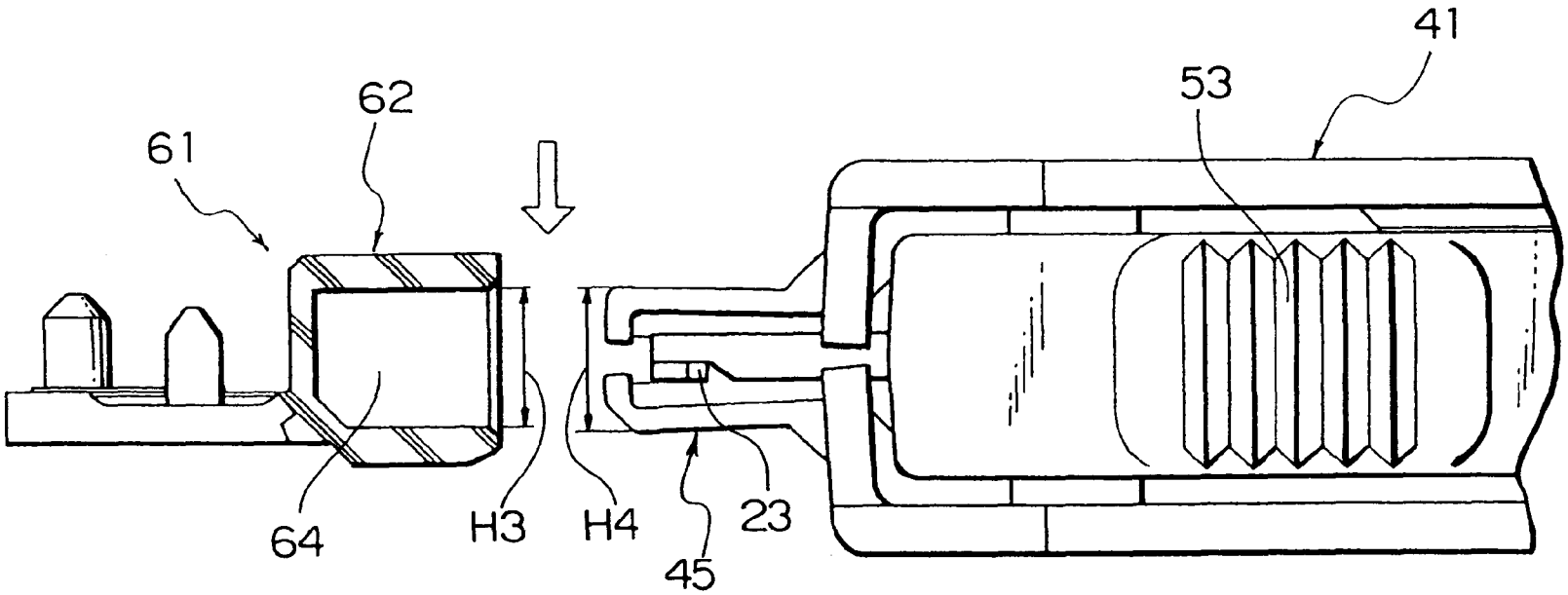
FIG. 13 is a partially-sectional side view showing the connector in FIG. 8 and the mating connector in FIG. 11 in a disconnected state.
Figure 14:
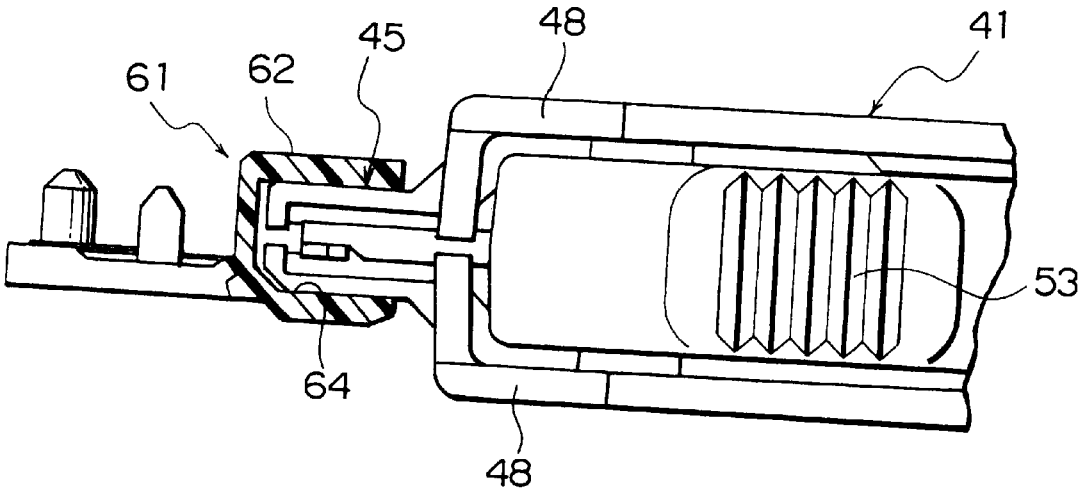
FIG. 14 is a view similar to FIG. 13 but in a connected state.

As illustrated in FIG. 13, the recessed portion 64 has an internal dimension H3 slightly smaller than an external dimension H4 of the guide portion 45. Therefore, as illustrated in FIG. 14, no gap is produced between the inner surface of the recessed portion 64 and the outer surface of the guide portion 45 when the plug connector 41 is coupled to the receptacle connector 61. Thus, it is possible to prevent mutual contact between the contacts 42 and the mating contacts 63 from being unstable due to presence of a gap therebetween.

Figure 15:
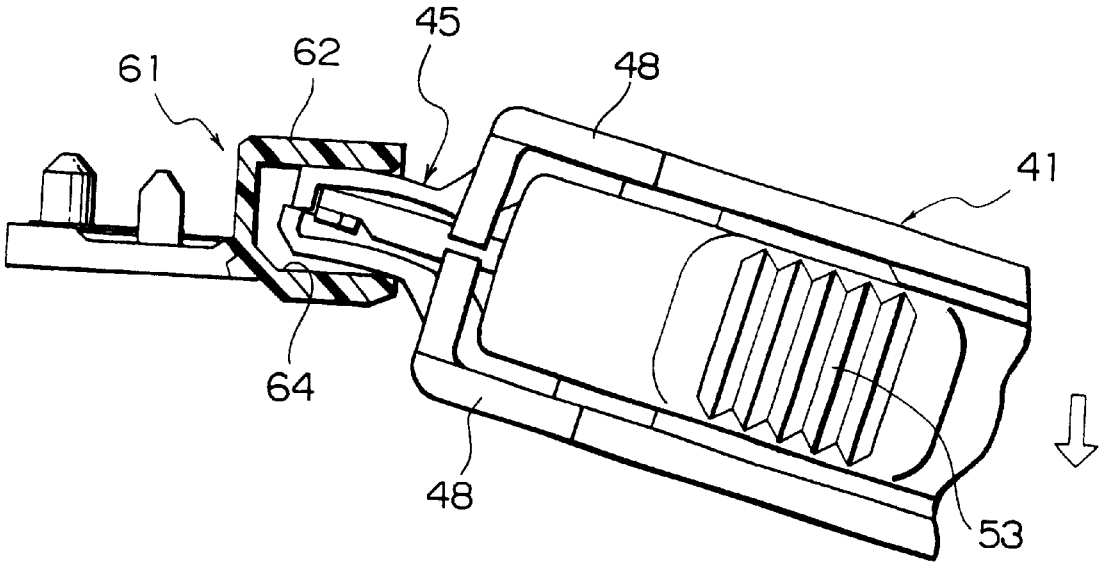
FIG. 15 is a view similar to FIG. 14 but when an external force is applied to the connector.

The guide portion 45 is rich in flexibility. Therefore, as illustrated in FIG. 15, the guide portion 45 is elastically bent if an external force is applied as depicted by a thick white arrow in the figure to cause relative vibration between the plug connector 41 and the receptacle connector 61. It is therefore possible to prevent occurrence of local cracks.

Figure 16:
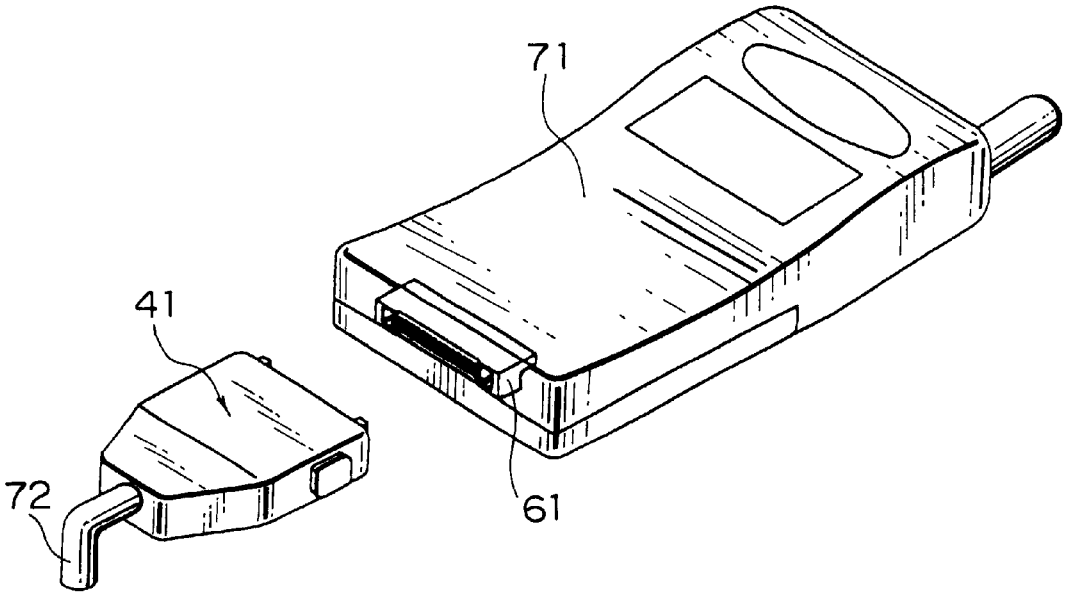
FIG. 16 is a perspective view for describing the use of the connector in FIG. 8 and the mating connector in FIG. 11 in a disconnected state.
Figure 17:
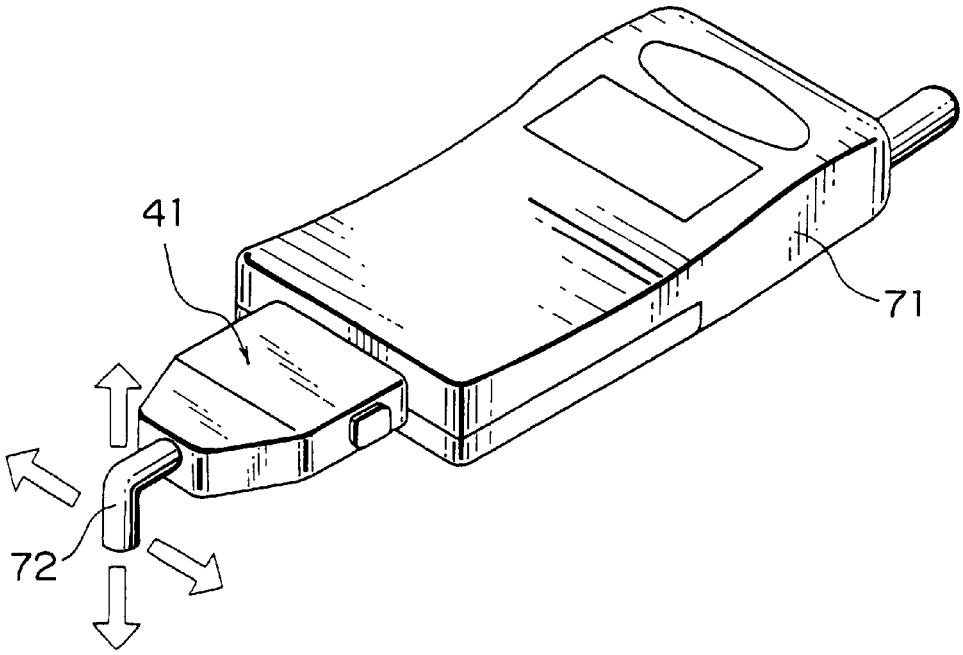
FIG. 17 is a view similar to FIG. 16 but in a connected state.

Referring to FIGS. 16 and 17, description will be made of an example of use of the plug connector 41 and the receptacle connector 61. In the illustrated example, the receptacle connector 61 is assembled into a terminal apparatus 71 such as a mobile telephone. On the other hand, the plug connector 41 is connected to a cord 72. As illustrated in FIG. 17, when the plug connector 41 is connected to the receptacle connector 61, the terminal apparatus 71 can be supplied with an electric signal through the plug connector 41 and the receptacle connector 61. Even if external force is applied to the cord 72 in various directions as depicted by thick white arrows in the figure, there is little possibility of causing the above-mentioned problems.

Furthermore, the plug connector 41 and the receptacle connector 61 are connected to each other and locked by the lock mechanism 52 without operating the operating portion 53. The operating portion 53 is operated only when the plug connector 41 is disconnected from the receptacle connector 61. Specifically, the locking claw 55 is engaged with an edge of the locking hole 66 of the lock plate 65 with the lock spring 54 elastically deformed. Thus, a locked state is achieved.

In the foregoing, the connector comprising the contacts of the butt-contact type is described. However, this invention is also applicable to a connector including a plurality of contacts of a different type.

What is claimed is:

1. A connector having a principal surface to be faced to an object in a first direction and a guide portion protruding from said principal surface in said first direction for guiding a connection of said connector and said object, wherein said guide portion has elasticity so as to be elastically bent in a second direction transverse to said first direction, said connector comprising an insulator holding an electroconductive contact and a hood covering said insulator, said hood having a hood center portion located at the center in a third direction perpendicular to said first and said second directions, and a hood end portion located at an end in said third direction, said guide portion protruding from said hood end portion in said first direction.

2. A connector as claimed in claim 1, wherein said guide portion has a slit to provide the elasticity.

3. A connector as claimed in claim 1, wherein comprising an electroconductive contact is located to be contacted to said object, said guide portion being formed as an integral part of said hood.

4. A connector as claimed in claim 1, wherein said hood comprises a pair of hood components butted to each other in said second direction, said guide portion comprising a pair of protruding portions integral with said hood components, respectively, said protruding portions being faced to each other in said second direction, each of said protruding portions having elastically so as to be elastically bendable in said second direction.

5. A connector as claimed in claim 4, further comprising a lock mechanism for locking a connected state between said connector and said object, said lock mechanism having a locking claw located between said protruding portions to be engaged with said object in said first direction.

6. A connector as claimed in claim 5, wherein said lock mechanism further comprises a movable operating portion formed on said hood, said locking claw being engaged with and disengaged from said object in cooperation with said operating portion.

7. A connector as claimed in claim 4, wherein a gap is left between said protruding portions.

8. A mating connector as an object to be connected to and disconnected from a connector claimed in claim 7, said mating connector comprising a mating insulator having a space for receiving said guide portion, said space having an internal dimension smaller than an external dimension of said guide portion.

9. A mating connector as claimed in claim 8, said mating connector including a lock plate held by said mating insulator, said lock plate having a locking portion faced to said space to be engaged with said locking claw.

* * * * *

UNITED STATES PATENT AND TRADEMARK OFFICE

CERTIFICATE OF CORRECTION

PATENT NO. : 6,454,592 B2
DATED : September 24, 2002
INVENTOR(S) : Osamu Takagi

It is certified that error appears in the above-identified patent and that said Letters Patent is hereby corrected as shown below:

Title page, Item [54] and Column 1, line 2,
After "CONNECTION" insert -- OF --

Signed and Sealed this

Sixteenth Day of September, 2003

JAMES E. ROGAN
*Director of the United States Patent and Trademark Office*